US005222347A

United States Patent [19]

Gerrans

[11] Patent Number: 5,222,347

[45] Date of Patent: Jun. 29, 1993

[54] SLIDE MOUNTER WITH SPRING LOADED INSERT GUIDES

[75] Inventor: Wilbur Gerrans, Marysville, Wash.

[73] Assignee: Pakon, Inc., Minnetonka, Minn.

[21] Appl. No.: 821,999

[22] Filed: Jan. 15, 1992

[51] Int. Cl.[5] ..... B65B 5/04; B65B 63/00; B65B 61/06

[52] U.S. Cl. ..... 53/520; 53/284.2; 83/278; 83/948

[58] Field of Search ..... 53/435, 520, 284.2, 53/77, 284.4; 83/221, 222, 278, 948, 373, 399, DIG. 1

[56] References Cited

U.S. PATENT DOCUMENTS

| | | | |
|---|---|---|---|
| 3,141,276 | 7/1964 | Anderson et al. | 53/520 |
| 3,521,423 | 7/1970 | Koeppe et al. | 53/284.2 |
| 3,524,299 | 8/1970 | Mundt et al. | 53/435 |
| 3,611,858 | 10/1971 | Beatty et al. | 83/222 X |
| 3,776,078 | 12/1973 | Perlman | 83/221 X |
| 3,788,031 | 1/1974 | Florjancic | 53/520 |
| 3,977,280 | 8/1976 | Mundt et al. | 83/42 |
| 3,992,243 | 11/1976 | Berggren et al. | 53/520 X |
| 4,003,187 | 1/1977 | Kiejzik | 83/373 X |
| 4,004,340 | 1/1977 | Urban | 29/435 X |
| 4,102,029 | 7/1978 | Thompson | 53/435 X |
| 4,135,343 | 1/1979 | Urban et al. | 53/435 |
| 4,237,678 | 12/1980 | Thompson | 53/284.2 X |
| 4,256,527 | 3/1981 | Green | 53/520 X |
| 4,331,260 | 5/1982 | Euteneuer et al. | 221/284.2 X |
| 4,345,707 | 8/1982 | Urban et al. | 226/68 |
| 4,355,748 | 10/1982 | Willenbring | 226/67 |
| 4,391,082 | 7/1983 | Diesch | 53/520 |
| 4,516,386 | 5/1985 | Willenbring | 53/520 |
| 4,543,771 | 10/1985 | Jensen et al. | 53/520 |
| 4,603,539 | 8/1986 | Müssig et al. | 53/435 |
| 4,612,754 | 9/1986 | Neuhold et al. | 53/284.2 X |
| 4,673,815 | 6/1987 | Fruth et al. | 250/548 |
| 4,698,883 | 10/1987 | Blättner et al. | 53/520 X |
| 4,738,040 | 4/1988 | Neuhold et al. | 40/152 |

*Primary Examiner*—Horace M. Culver
*Attorney, Agent, or Firm*—Kinney & Lange

[57] ABSTRACT

The present invention relates to an apparatus for mounting a film transparency into a slide mount to prepare a photographic slide. The apparatus is useful for preparing a photographic slide for a slide mount of the type formed of upper and lower frame sections connected along an outer border to define a pocket therebetween. The slide mount also includes a slit adjacent to the outer border to separate the upper and lower frame sections to define a first insertion opening adjacent to the slit and a second insertion opening into the pocket of the slide mount. Cooperating film guides are positioned adjacent to the second insertion opening to guide a leading edge of the film transparency, which is inserted into the pocket of the slide mount, through the second insertion opening of the slide mount.

29 Claims, 10 Drawing Sheets

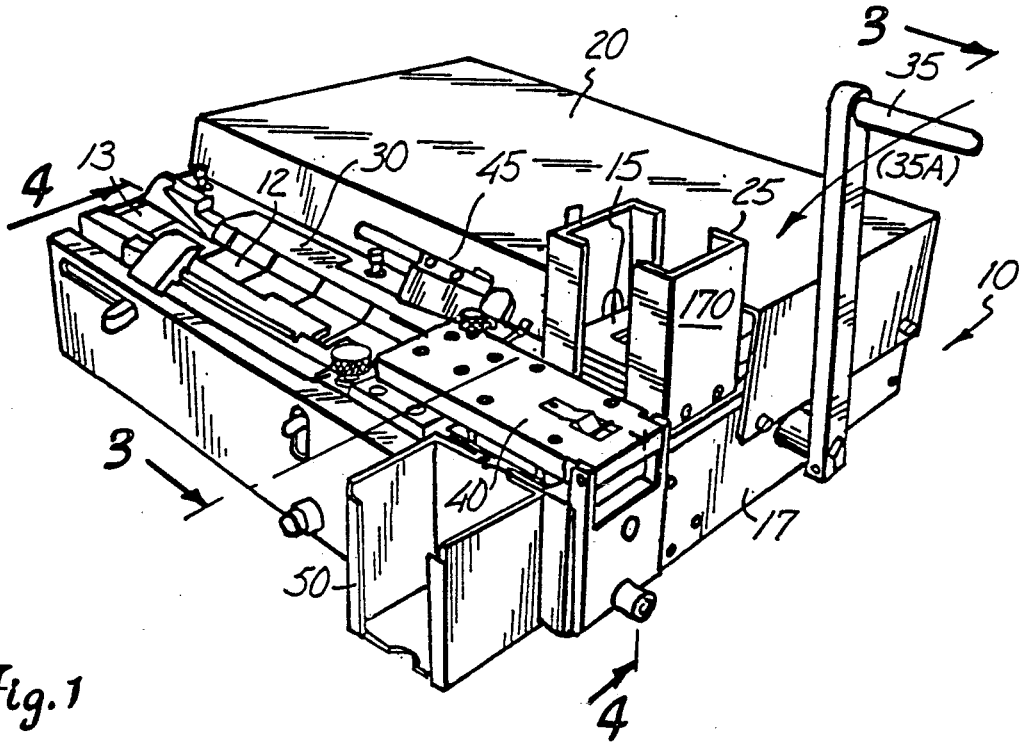
Fig. 1
Fig. 5
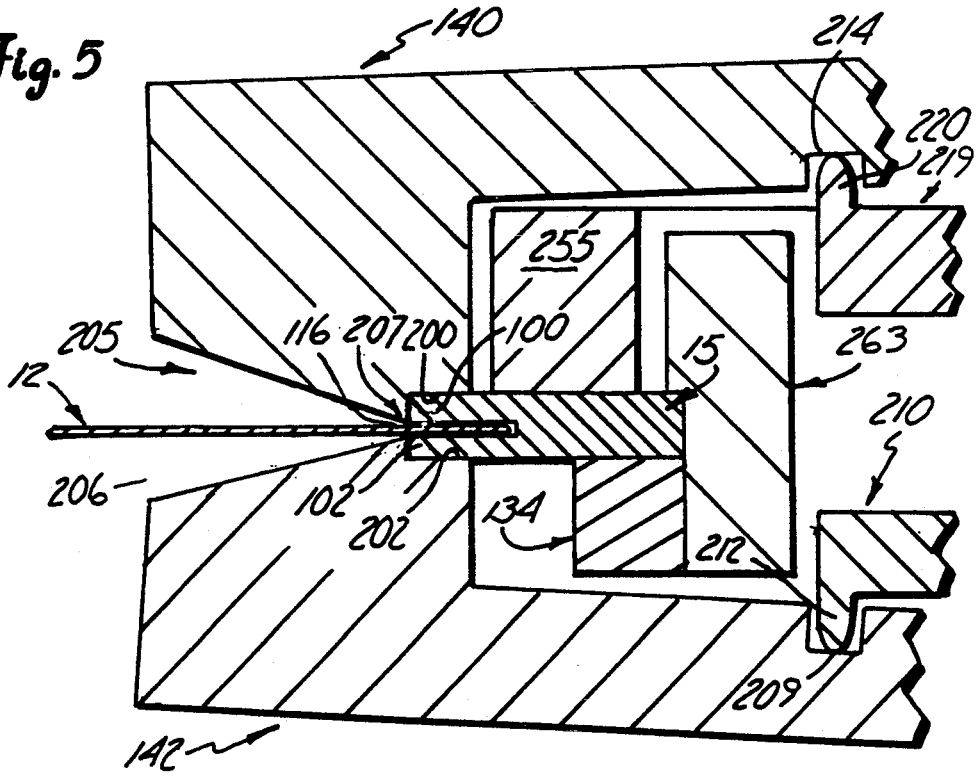

SLIDE MOUNTER WITH SPRING LOADED INSERT GUIDES

REFERENCE TO COPENDING APPLICATIONS

Reference is made to the following commonly assigned applications entitled as follows:

(1) Slide Mounter with Bridging Film Advance (U.S. application Ser. No. 07/822,188); (2) Slide Mounter with Movable Knife Assembly (U.S. application Ser. No. 07/821,025); (3) Slide Mounter with Motor/Arm Interlock (U.S. application Ser. No. 07/821,752); (4) Slide Mounter with In-Plane Film Pusher (U.S. application Ser. No. 07/821,762); (5) Slide Mounter with Positive Stop Film Placement (U.S. application Ser. No. 07/822,029); and (6) Slide Mounter with Improved Slide Mount Advance (U.S. application Ser. No. 07/820,988). All of the above-identified Applications being filed on Jan. 15, 1992, the same filing date as the instant Application.

BACKGROUND OF THE INVENTION

The present invention relates to an apparatus for mounting a photographic film transparency into a slide mount.

Photographic film transparencies are generally severed from a photographic film web and mounted in individual slide mounts to prepare photographic slides. The exposed image of the prepared photographic slide is then viewed in cooperation with a slide projector or other visualizing means.

One popular form of slide mount is the Pakon plastic slide mount sold by Pakon, Inc., the assignee of the present application. The Pakon, Inc. plastic slide mount is generally constructed of upper and lower plastic frame sections connected along an outer border to form a pocket. The slide mount includes an aperture enclosed by an inner border, and a slit located adjacent to the outer border to define a first insertion opening. The photographic film transparency is inserted through the first insertion opening and advanced through the pocket of the slide mount to position the developed image within the aperture of the slide mount. To completely insert the film transparency into the pocket, a leading edge of the film transparency is inserted past a second insertion opening formed between the upper and lower frame sections at a side of the inner border furthest from the slit.

The upper and lower frame sections of the Pakon, Inc. slide mount are formed of a resilient plastic material. The slit defining the first insertion opening is normally closed. During operation, the upper and lower frame sections are forced apart at the slit by a separating force to define the first and second insertion openings The leading edge of the film transparency is inserted through the first and second insertion openings and advanced into the pocket of the slide mount. The resiliency of the material of the slide mount causes the upper and lower frame sections to close after the film is completely inserted into the slide mount and the separating force is released.

As previously mentioned, to complete the photographic slide, the leading edge of the film transparency must be fed through the second insertion opening defined between the upper and lower frame sections at an inner border furthest from the slit so that the leading edge of the film transparency completely advances into the pocket. Generally, the leading edge of the film transparency is fed through the first insertion opening without difficulty. However it is more difficult to guide the leading edge of the film transparency through the second insertion opening than to guide the leading edge through the first insertion opening. This is particularly so if the film transparency is unsupported along the length of the pocket. This difficulty is aggravated by the fact that the film transparency has a tendency to curl since it is originally wrapped around a reel and stored as a part of a rolled photographic film web. Thus, when advanced, particularly when advanced unsupported, the film transparency has a tendency to want to return to its original wrapped position. Also, the emulsion with which the photographic film is coated causes the film transparency to curl along a direction of advancement of the film transparency through the slide mount The propensity of the film transparency to curl is further aggravated by an insertion force which is applied to advance the film transparency through the pocket of the slide mount.

Because the leading edge of the film transparency has a tendency to curl, it is often difficult to align the leading edge with the second insertion opening to completely insert the film transparency into the pocket of the slide mount. If the film transparency curls before it is inserted through the second insertion opening, the slide mounting apparatus will jam and any further application of insertion force to the film transparency will cause the film transparency to buckle. When this occurs, quite often, the exposed film transparency is destroyed and the developed image is lost forever. Also, at this time it is necessary to stop operation of the apparatus to clear the defectively mounted photographic slide and to correct any misalignment of the film caused by the jamming.

Thus, there has been a continuing need to develop an apparatus for mounting a film transparency into a slide mount where the film transparency is not particularly prone to misalignment before the film transparency is completely inserted into the pocket of the slide mount. In particular, there has been a continuing need to develop an apparatus to facilitate the insertion of the film transparency through the second insertion opening to complete the photographic slide of the film transparency.

SUMMARY OF THE INVENTION

The present invention relates to an apparatus for mounting a photographic film transparency into a slide mount to produce a photographic slide for viewing The apparatus includes means for positioning the slide mount at an insertion station with the upper and lower frame sections forced apart at the slit to define the first and second insertion openings through which the leading edge of film transparency is inserted. The film transparency is advanced through the slit and the pocket toward the second insertion opening. Film guiding means are positioned to cooperate with the second insertion opening to facilitate the insertion of the leading edge of the film transparency through the second insertion opening, so that the film is completely inserted into the pocket.

BRIEF DESCRIPTION OF THE DRAWINGS

The invention will be further descried with reference to the accompanying drawings where like numbers refer to like parts in several views.

FIG. 1 is a perspective view of a photographic slide mounter of the present invention.

FIG. 5 is an enlarged detailed cross-sectional view of the operation of upper and lower film guides for guiding the film for insertion into an individual slide mount.

Figure 2:
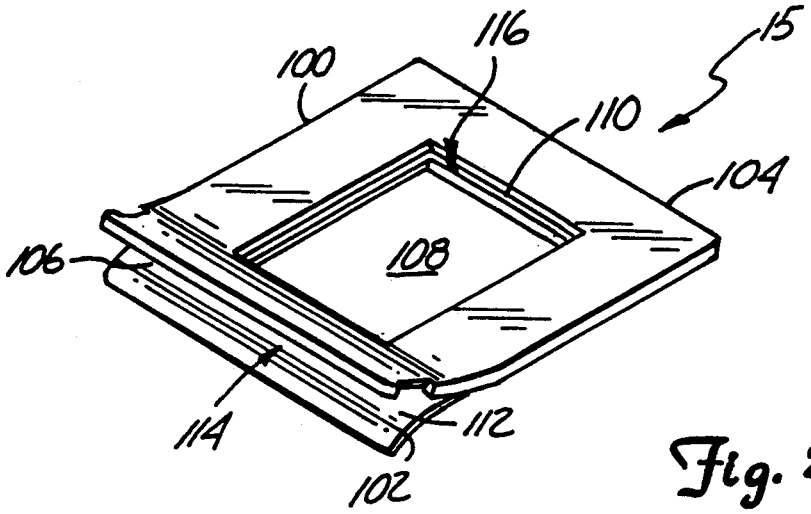
FIG. 2 is a perspective view of a typical slide mount for application with the slide mounting apparatus of the present invention

While the above-identified drawings figures set forth in the preferred embodiment, other embodiments of the present invention are also contemplated, thus, this disclosure presents an illustrated embodiment of the present invention by way of representation and not limitation. It should be understood that numerous other modifications and embodiments can be devised by those skilled in the art which fall within the scope and spirit of the principles of this invention. It should be noted that the figures have not been drawn to scale.

DETAILED DESCRIPTION OF THE PREFERRED EMBODIMENTS

(1) Overview of Slide Mounter (FIG. 1)

FIG. 1 shows a semi-automatic slide mounter 10 which is used to sever individual film transparencies 12 from a photographic film web 13 for insertion into a slide mount 15 to prepare a photographic slide. The slide mounter 10 includes a base frame 17 and a cover 20. The slide mounts 15 are stored in stacked relation in a slide magazine 25. The photographic film web 13 is supported for movement along a film track 30.

An operating lever 35 initiates the operation of the slide mounter 10. In operation, the operating lever 35 is advanced forward (arrow 35A) to eject a slide mount 15 from the slide magazine 25. The ejected slide mount 15 is advanced to an insertion station 40. A motorized drive assembly (not shown) is synchronized with the release of the operating lever 35 to advance the film web 13 along the film track 30 toward the insertion station 40. A knife assembly 45 aligned with the film track 30 is used to sever individual film transparencies 12 from the film web 13. Each time the operating lever 35 ejects a slide mount 15, the motorized drive advances the film web 13 along the film track 30 to sever a leading film transparency 12 and insert a severed film transparency 12 into the ejected slide mount 15. An operation cycle of the motor assembly begins each time the operating lever 35 is released from a forward position. A catch magazine 50 holds the photographic slides after each is prepared.

(2) Description of the Slide Mount 15 (FIG. 2)

As shown in FIG. 2, the slide mounts 15 contemplated for use with the slide mounter 10 of the present invention, are formed of an upper frame section 100 and a lower frame section 102 connected along an outer border 104 to define a pocket 106 therebetween into which individual film transparencies 12 are inserted. The slide mount 15 includes a central aperture 108 defined by an inner border 110 where the exposed image of the film transparency 12 is positioned. The slide mounts 15 have a slit 112 along the outer border 104 which is forced open during operation to define a first insertion opening 114 (adjacent the slit 112). A second insertion opening 116 is defined by the spacing between the upper and lower frame sections 100 and 102 along a side of the inner border 110 furthest from the slit 112. The film transparency 12 is inserted through the first and second insertion openings 114 and 116 to advance the film 12 into the pocket 106 of the slide mount 15.

Figure 3:
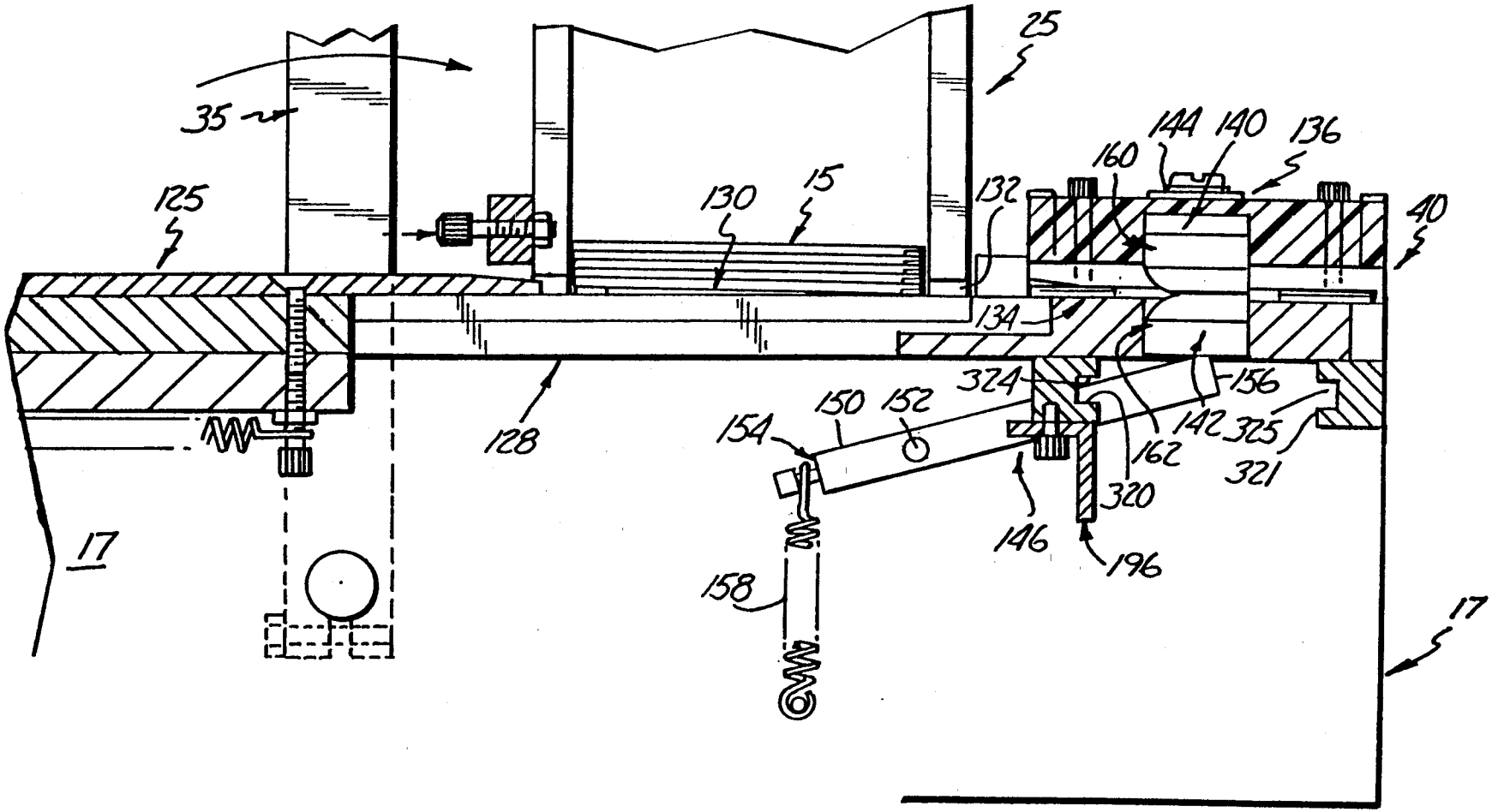
FIG. 3 is a cross-sectional view as taken along line 3—3 of FIG. 1 illustrating a slide ejector for ejecting individual slide mounts from a slide magazine for operation.

(3) Slide Ejector (FIG. 3)

Figure 6A:
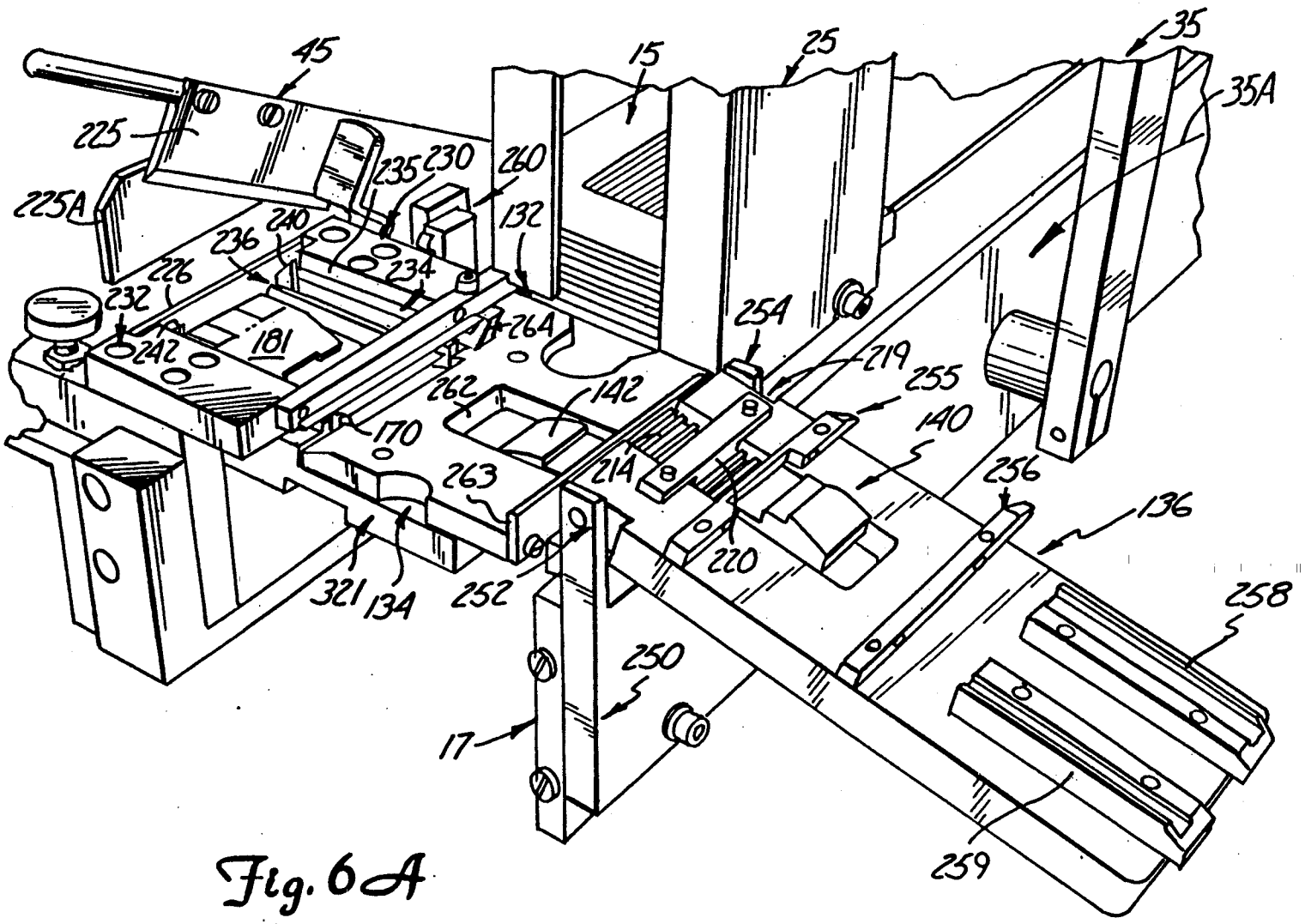
FIG. 6A is a detailed perspective view, shown with the lid flipped back, of an insertion station of FIG. 1 at the intersection of a slide track and a film track for inserting a severed film transparency into an individual slide mount.
Figure 6B:
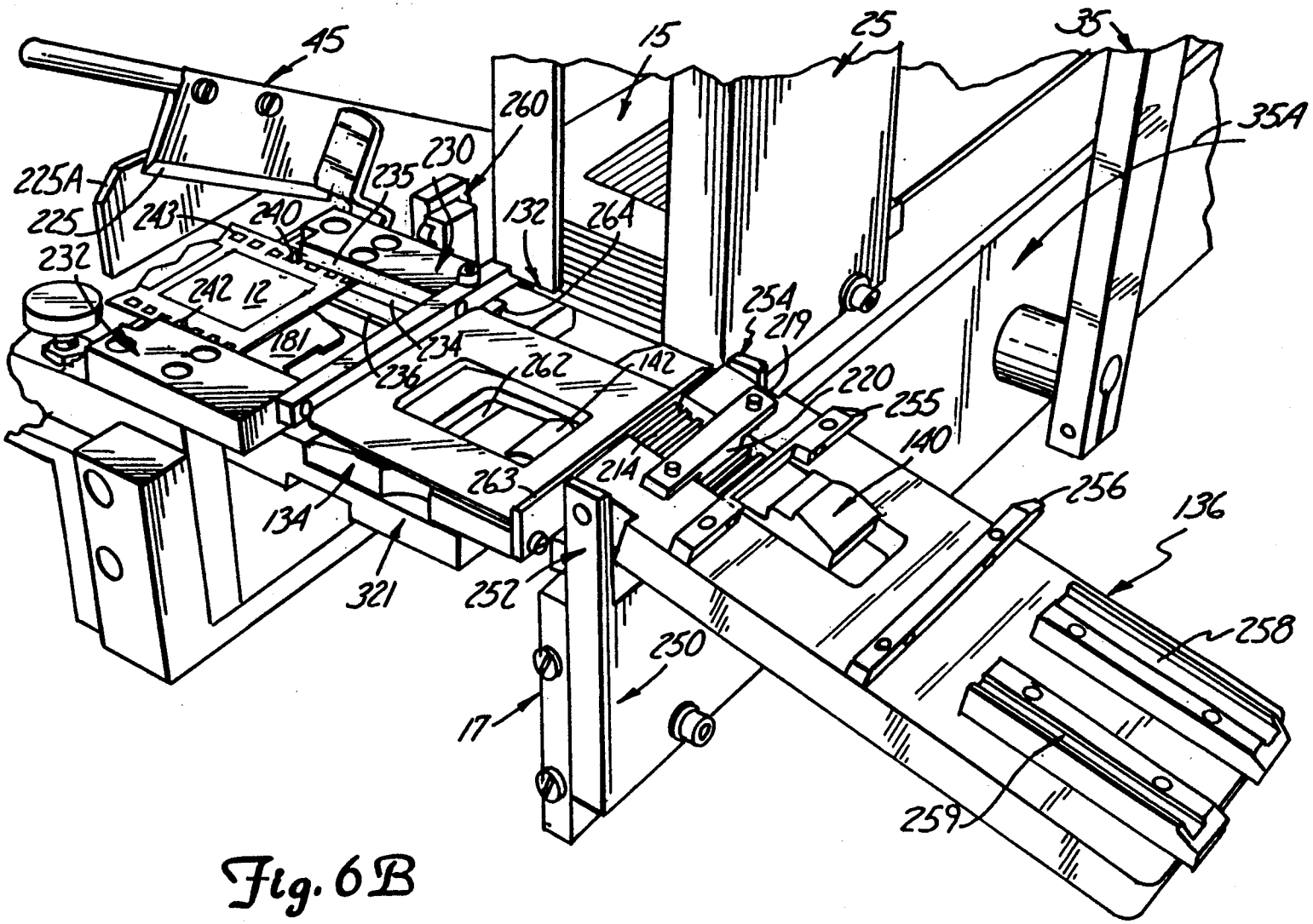
FIG. 6B is a similar detailed perspective view of the insertion station as shown in FIG. 6A, with a slide mount shown in position to receive a severed film transparency.

As shown in FIG. 3, the slide mounts 15 are ejected from the slide magazine 25 and advanced to the insertion station 40 by a slide ejector 125 movable along an ejector track 128 connected to the frame 7 and perpendicular to the film track 30 (FIG. 1). The slide ejector 125 is advanced along the ejector track 128 to force a bottom slide mount 130 through a slide mount opening 132 (FIGS. 3, 6A and 6B) onto a slide track 134 aligned with the insertion station 40. The slide ejector 125 is operably connected to the operating lever 35 and advanced in cooperation therewith The slide track 134 extends to the insertion station 40 which defines an intersection for the slide track 134 and the film track 30 to support the ejected slide mount 15 which is advanced to the insertion station 40 (FIG. 6B). A lid 136 covers the insertion station 40 during operation.

An upper film guide 140 and a lower film guide 142 are included at the insertion station 40. A leaf spring 144 engages the upper film guide 140 to force it toward the lower film guide 142 during operation (FIGS. 4A–4C and 8).

A spring biased contact assembly 146 engages the lower film guide 142 to force it toward the upper film guide 140 (FIGS. 3, 4A–4C and 7). The spring biased contact assembly 146 includes a contact bar 150 which is mounted to the frame 17 of the slide mounter 10 at a pivot 152. The contact bar 150 has a first end 154 and a second end 156 aligned with the lower film guide 142. A helical spring 158, fixed at one end to the frame 17, is connected, at another end, to the first end 154 of the contact bar 150 to force the second end 156 upward to contact the lower film guide 142 to bias the lower film guide 142 toward the upper film guide 140.

The upper and lower film guides 140 and 142 include cooperating curved surfaces 160 and 162, respectively, aligned with the slide mount 15 ejected from the slide magazine 25. The cooperating curved surfaces 160 and 162 define a receiving opening for the slide mount 15 to force the upper and lower film guides 140 and 142 apart against the spring bias to advance the slide mount 15 past the upper and lower film guides 140 and 142 for placement at the insertion station 40. The slide advanced past the upper and lower film guides 140 and 142 until the slide mount 15 encloses the film guides 140 and 142 adjacent to the second insertion opening 116 of the slide mount 15.

Figure 4A:
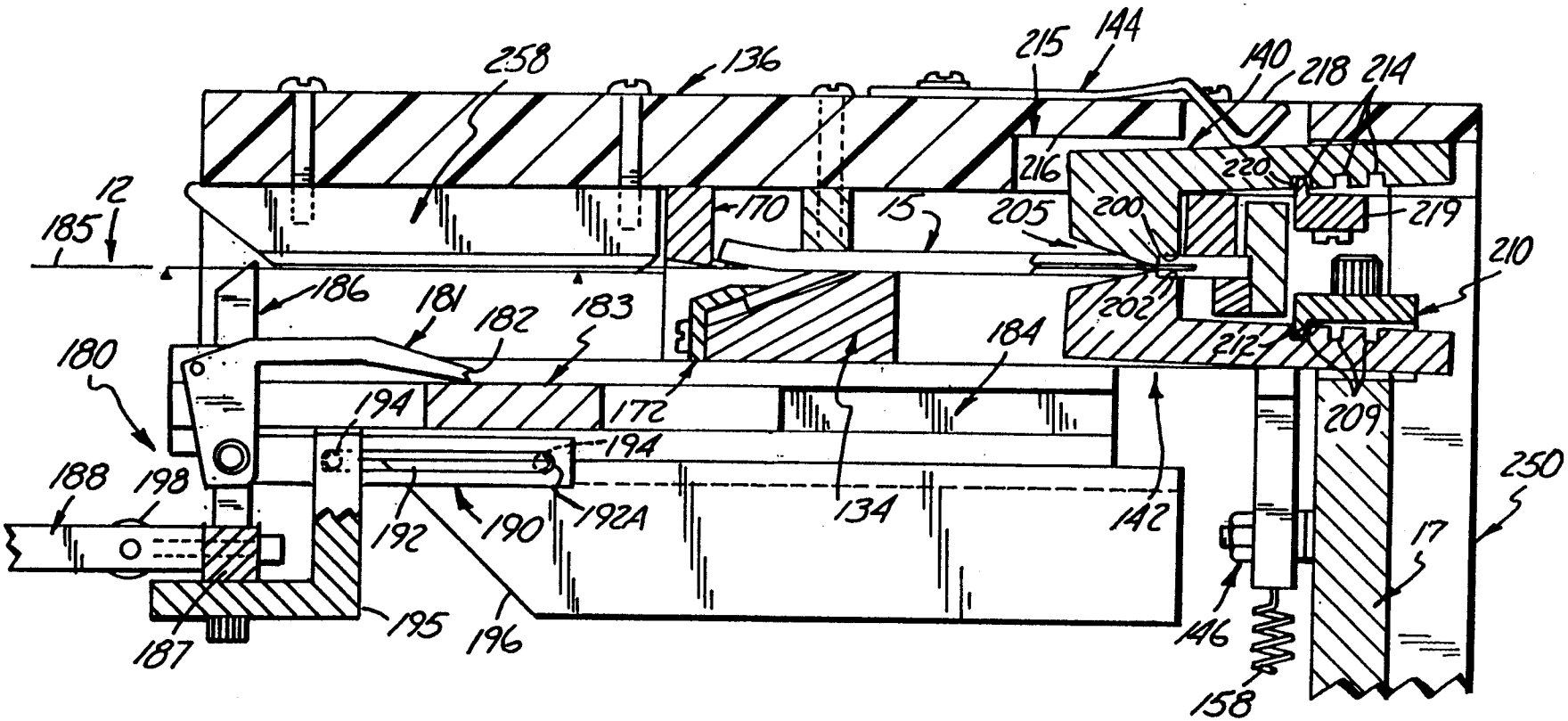
FIG. 4A is a cross-sectional view as taken along line 4—4 of FIG. 1 perpendicular to the slide ejector, illustrating a pusher/finger assembly having a pusher with the pusher shown in a retracted position.
Figure 4B:
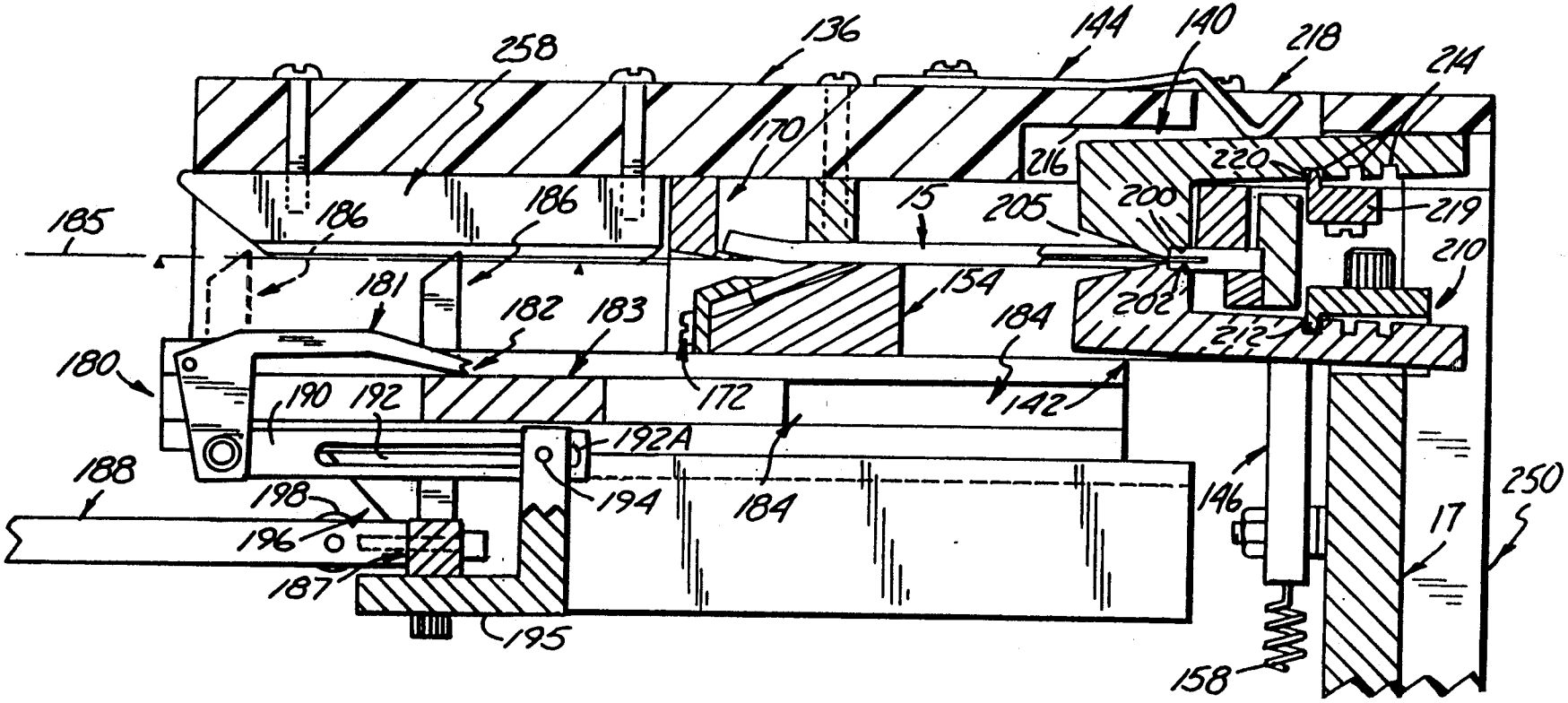
FIG. 4B is a cross-sectional view, similar to FIG. 4A, with fingers of the pusher/finger assembly advanced for operation.
Figure 4C:
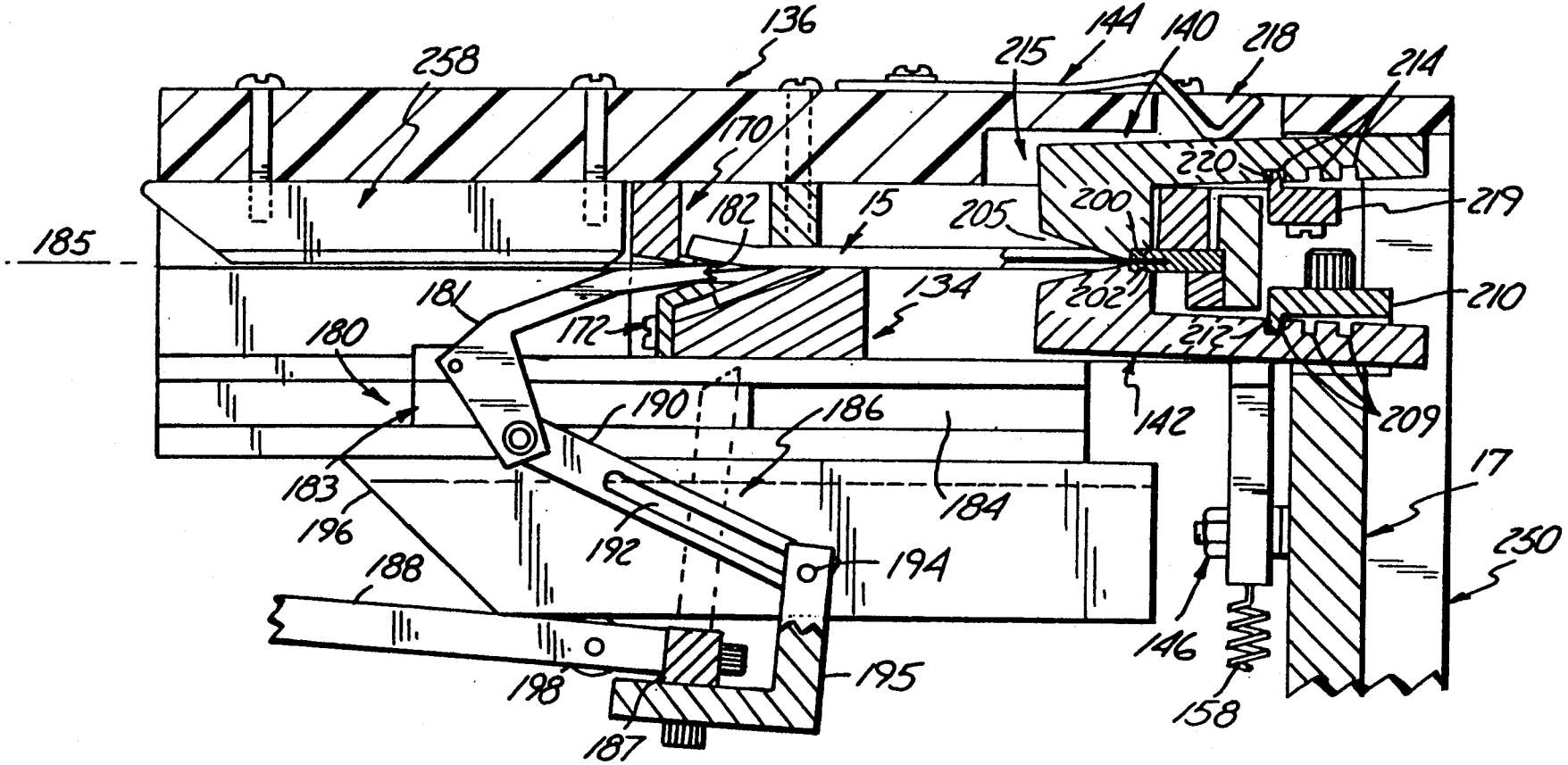
FIG. 4C is a cross-sectional view, similar to FIGS. 4A and 4B, with the pusher of the pusher/finger assembly shown in an engaging position during operation.

As the slide mount 15 is advanced to the insertion station 40, the upper and lower frame sections 100 and 102 are separated at the slit 112 to define the first insertion opening 114. As shown in FIGS. 4A–4C, the slide track 134 includes upper and lower retaining ledges 170 and 172, aligned with the slit 112 of the ejected slide mount 15, to hold the pocket 106 of the slide mount 15 open to receive a film transparency 12.

(4) Operation of Pusher/Finger Assembly (FIGS. 4A–4C)

As previously explained, the photographic film web 13 is supported along a film track 30 perpendicular to the slide ejector 125 (FIG. 1). Individual film transparencies 12 are severed from the film web 13. The severed film transparencies 12 are advanced toward the insertion station 40 and inserted into the ejected slide mount 15 by a pusher/finger assembly 180 (FIGS. 4A–4C). The pusher/finger assembly 180 is movably supported to engage the severed film transparency 12 and advance toward the insertion station 40 to insert the severed film transparency 12 into the slide mount 15 as progressively illustrated in FIGS. 4A–4C.

The pusher/finger assembly 180 includes a pusher 181 having a front grooved surface 182 designed to engage a trailing edge of the severed film transparency 12. The pusher 181 is pivotally supported by a movable pusher support 183 designed to move along a pusher track 184. The pivotal connection of the pusher 181 to the movable pusher support 183 allows the pusher 181 to operate between a retracted position (below a film plane 185 (FIG. 4A)) and an engaging position (aligned with the film plane 185 (FIG. 4C)) to align the front grooved surface 182 with the trailing edge of the film transparency 12. A finger assembly 186 advances the severed film transparency until the trailing edge thereof aligns with the pusher 181. The finger assembly 186 includes a finger support block 187 which connects the finger assembly 186 to a actuator 188 which is operably connected to the motor assembly (not shown). The finger assembly 186 is advanced by the actuator 188 to align the severed film transparency 12 with the front grooved surface 182 of the pusher 181.

The pusher 181 is connected to a link bar 190 which includes a stroke slot 192. A connecting rod 194 extends through the stroke slot 192. The connecting rod 194 is supported by a connecting rod support 195 which is attached to the finger support 187 and, in turn attached to the actuator 188.

As the actuator 188 advances the finger assembly 186, the connecting rod 194 advances along the stroke slot 192 toward a contact end 192A (FIGS. 4A and 4B). As shown in FIG. 4C, the actuator 188 is advanced so that the connecting rod 194 engages the contact end 192A of the stroke slot 192. When the connecting rod 194 engages the contact end 192A, the pusher 181 is rotated from the retracted position (FIGS. 4A and 4B) to the engaging position (FIG. 4C) to advance the film transparency 12. Thereafter, the link bar 192, via the connecting rod 194, transfers the motion of the actuator 188 to move the pusher 181, after the finger assembly 186 has aligned the trailing edge of the severed film transparency 12 with the front grooved surface 182 thereof, to insert the film transparency 12 into the slide mount 15.

A ramped surface 196 is aligned with the actuator 188. A roller 198 is attached to a leading end of the actuator 188 and interacts with the ramped surface 196 to force the actuator 188 downward, and the finger assembly 186 therewith as shown in FIG. 4C. The operation of the actuator 188 continues after the roller 198 contacts the ramped surface 196 to advance the pusher 181, via the link bar 190, to insert the severed film transparency 12 into the slide mount 15 in cooperation with the upper and lower film guides 140 and 142.

The construction and operation of the pusher/finger assembly 180 are discussed in more detail later in section (10).

(5) Operation of the Upper & Lower Film Guides (FIGS. 4A–4C)

As shown in FIGS. 4A–4C and in more detail in FIG. 5, the upper and lower film guides 140 and 142 each include stepped edges 200 and 202, respectively. The stepped edges 200 and 202 of the upper and lower film guides 140 and 142 seat against upper and lower frame sections 100 and 102, respectively, of an ejected slide mount 15 adjacent to the second insertion opening 116 to open the upper and lower film guides 140 and 142 against the spring biased to define a tapered passage 205 having an inlet 206 and an outlet 207 (FIG. 5).

The severed film transparency 12 is introduced into the tapered passage 205 through inlet 206. The film transparency 12 is advanced through the tapered passage 205 and funneled towards the outlet 207 aligned with the second insertion opening 116 of the slide mount 15. Thus, the upper and lower film guides 140 and 142 cooperate to direct the leading edge of the severed film transparency 12, advanced by the pusher/finger assembly 180, through the second insertion opening 116 until the slide transparency 12 is completely inserted into the pocket 106 and the exposed image is squarely positioned within the aperture 108 of the slide mount 15.

Again in FIGS. 4A–4C, the lower film guide 142 includes a plurality of placement grooves 209 and is adjustably mounted to the frame 17 by a lower film guide mount 210. The lower film guide mount 210 includes a placement extension 212 which mates with one of the several placement grooves 209 of the lower film guide 142 to contact and locate the position of the film guide 142 for operation.

If necessary, the attachment of the lower film guide mount 210 to the frame 17 can be loosened to shift the lower film guide 142 to align a different placement groove 209 with the placement extension 212 of the lower film guide mount 210. The position of the lower film guide 142 is adjusted so that the stepped edge 202 seats against the lower frame section 102 of the slide mount 15 adjacent to the second insertion opening 116 (FIG. 5).

In particular, there are typically three standard size slide mounts 15 having different aperture opening widths. The placement grooves 209 of the lower film guide 142 are arranged so that when engaged by the placement extension 212 of the lower film guide mount 210, each placement groove 209 positions the lower film guide 142, relative to the second insertion opening 116, for one of the three standard size slide mounts 15. Thus, prior to operation, the standard slide mount 15 size is determined and the lower film guide 142 is adjusted until the placement extension 212 of the guide mount 210 aligns with the proper placement groove 209 corresponding to the slide mount 15 size.

Figure 8:
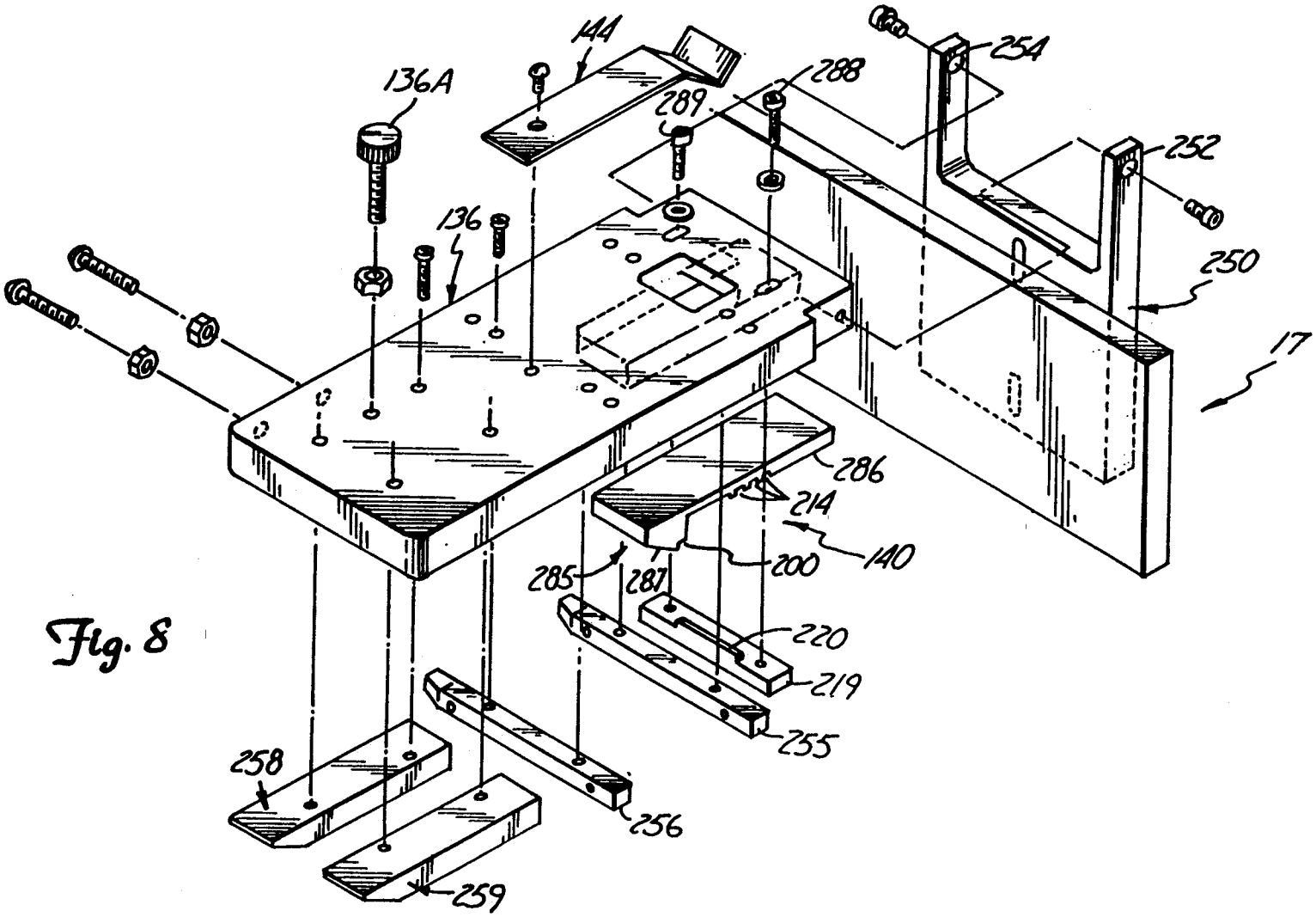
FIG. 8 is an exploded perspective view of the construction of the upper film guide of the present invention.

As shown in FIGS. 4A–4C, the lid 136 supports the upper film guide 140 which includes a plurality of placement grooves 214. The lid 136 has a stepped cavity 215 on a lower surface thereof. The stepped cavity 215 defines a support recess 216 and a through opening 218. The upper guide 140 is seated in the support recess 216 and held in place by a cross bar 219 connected to the lid 136 (FIGS. 6A–6B and 8). The cross bar 219 includes a placement extension 220 which mates with one of the several placement grooves 214 of the upper film guide 140 to contact and locate the upper film guide 140 for operation. Similar to the lower film guide 142, the upper film guide 140 is adjusted for the standard slide mount 15 size by moving the film guide 140 to align a different placement groove 214 with the placement extension 220. The leaf spring 144 is mounted to an upper surface of the lid 136 to contact the upper film guide 140 through the through opening 218 to spring bias the upper film guide 140 toward the lower film guide 142 as previously explained.

The construction and operation of the upper and lower film guides 140 and 142 are described in further detail in sections (8) and (9).

(7) Inserting the Film into the Slide Mount (FIGS. 6A & 6B)

As described, the operating lever 35 is pulled forward (arrow 35A, FIGS. 6A and 6B) to operate the slide ejector 125 to eject a slide mount 15 from the slide magazine 25 to the insertion station 40. The operation of the motor drive assembly (not shown) is synchronized with the operation of the operating lever 35 to advance the film web 13 upon release of the operating lever 35. The film web 13 is advanced to the knife assembly 45. The knife assembly 45 includes an upper knife blade 225 and a lower knife blade 226 pivotally connected (not shown) to close to sever an individual film transparency 12 from the film web 13. A knife guard 225A is included to protect the user.

As shown in FIGS. 6A & 6B, film receiving supports 230 and 232 are aligned with the film track 30, on an opposite side of the knife assembly 45, to support the severed film transparency 12. The film receiving supports 230 and 232 are supported at an advanced end of the film track 30, which is connected to the frame 17 and each includes a support ledge 234 and a guide edge 235. Parallel supports 236 are aligned with and spaced from each support ledge 234 to cooperatively support the severed film transparency 12 along each lateral edge of the film. The parallel supports 236 are mounted to the slide track 134 and extend therefrom. Fingers 240 and 242 of the finger assembly 186 (FIGS. 4A–4C) extend between each support ledge 234 and parallel support 236 to contact the film transparency 12 through sprocket holes 243 along the lateral edges of the film transparency 12 (FIG. 6B).

A lid support 250 having first and second support extensions 252 and 254 is connected to the frame 17. The lid 136 is pivotally connected to the lid support 250 between the first and second support extensions 252 and 254. The lid 136 is rotatably supported to adjust between an operational position (lid 136 parallel to insertion station 40, FIGS. 1, 3 and 4A–4C) and a "flipped back," non-operational position (FIGS. 6A and 6B). A first slide mount guide 255 and a second slide mount guide 256 are secured to a lower surface of the lid 136. First and second finger guides 258 and 259 are attached to a lower surface of the lid 136 to guide the first and second fingers 240 and 242 (when the lid 136 is in the operational position). The first and second slide mount guides 255 and 256 maintain the ejected slide mount 15 with respect to the insertion station 40 (when the lid 136 is in the operational position).

A contact switch 260 is operably connected to the motor assembly (not shown) to restrict operation of the motor assembly when the lid 136 is in the "flipped back" non-operational position (FIGS. 6A and 6B) and the upper film guide 140 is not in place. Thus, when the lid 136 contacts the switch 260 in the operational position (FIGS. 1, 3 and 4A–4C), the lid 136 closes the circuit to enable operation of the motor assembly (not shown) and, when the lid 136 is flipped back in the non operational position (FIGS. 6A and 6B), the switch 260 is opened to inhibit operation of the motor assembly.

The slide track 134 includes an aperture window 262 and a slide mount guide 263 at the insertion station 40. The slide track 134 also includes a slide mount opener 264 to force open the slit 112 of the slide mount 15 which is held open during operation by the upper retaining ledge 170 and the lower retaining ledge 172 (FIGS. 4A–4C). Lower film guide 142 extends through window 262 and is contacted by the contact bar 150 of the spring biased contact assembly 146 through the window 262 (FIG. 3).

Figure 7:
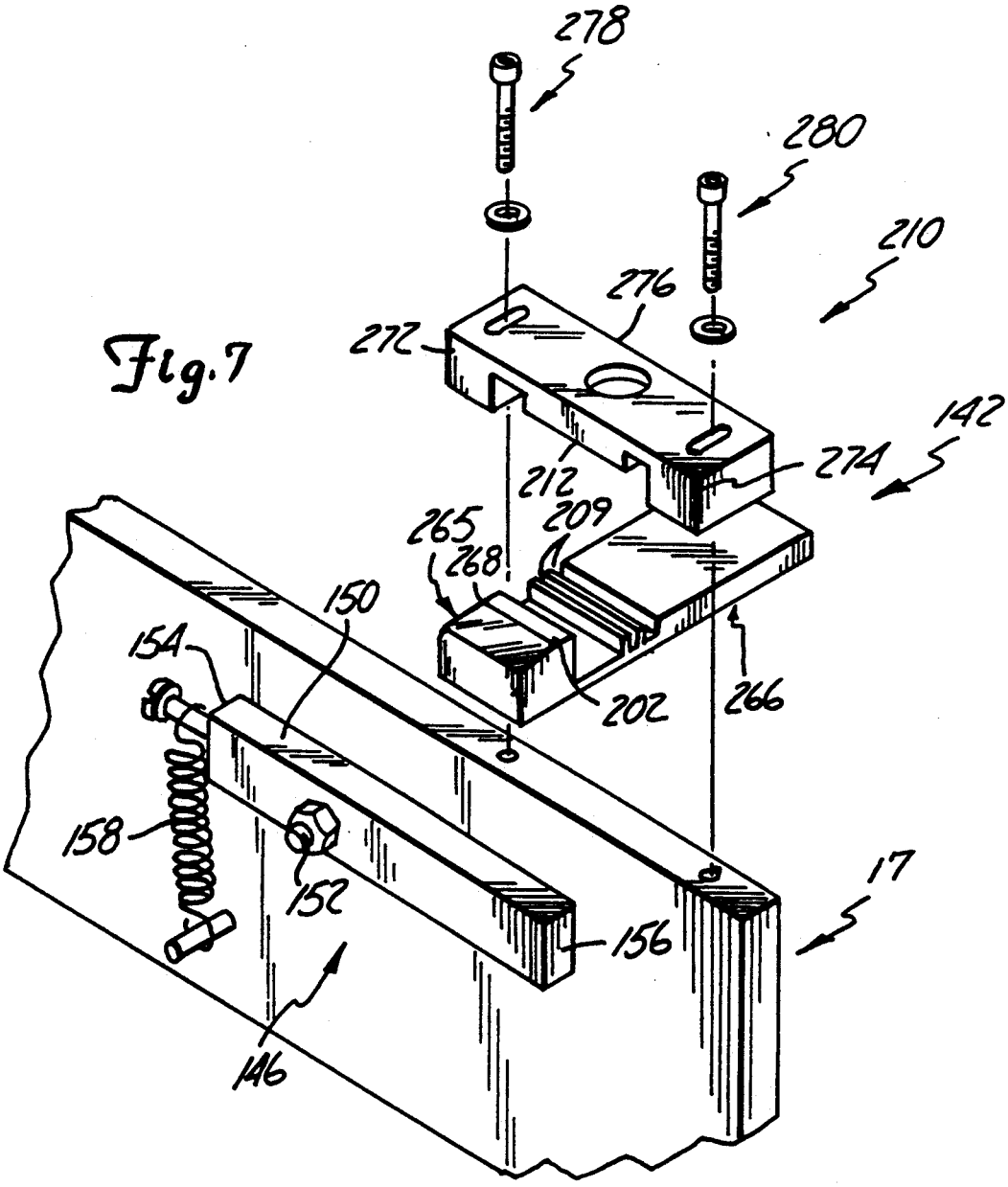
FIG. 7 is an exploded perspective view of the construction of the lower film guide of the present invention.

(8) Detailed Description of Lower Film Guide (FIG. 7)

More particularly, as shown in FIG. 7, the lower film guide 142 includes a head 265 and a support extension 266. The head 265 includes an upper tapered surface 268 extending to the stepped edge 202. The tapered surface 268 of the lower film guide 142 defines a lower edge of the tapered passage 205 (FIG. 5). The placement grooves 209 are on an upper surface of the extension 266.

The lower film guide mount 210 is a generally "C" shaped member defining a first mounting extension 272, a second mounting extension 274 and a connecting portion 276. The placement extension 212 (FIGS. 4A–4C, 5, 6A and 6B) extends from the connecting portion 276. Attachment bolts 278 and 280 secure the opposed mounting extensions 272 and 274 of the lower film guide mount 210 to the frame 17.

As previously explained, the stepped edge 202 of the head 265, which extends through the aperture window 262 (FIGS. 6A and 6B) of the slide track 134, is positioned adjacent to the second insertion opening 116 of the slide mount 15. If necessary, the attachment bolts 278 and 280 of the lower film guide mount 210 are loosened to adjust the position of the lower film guide 142 and align a different placement groove 209 with the placement extension 212 of the lower film guide mount 210 so that the notched edge 202 is adjacent to the second insertion opening 116 of the slide mount 15 as shown in FIG. 5. After the lower film guide 142 is correctly adjusted, the attachment bolts 278 and 280 are tightened to secure the lower film guide 142 for operation.

(9) Detailed Description of the Upper Film Guide (FIG. 8)

Similarly, as shown in FIG. 8, the upper film guide 140 includes a head 285 and a support extension 286. The head 285 includes a lower tapered surface 287 extending to the stepped edge 200. The tapered surface 287 of the upper film guide 140 defines an upper edge of the tapered passage 20 (FIGS. 4A–4C and 5). The placement grooves 214 extend from a lower surface of the extension 286.

As described (FIGS. 4A–4C and 8), the upper film guide 140 is maintained within the stepped cavity 215 of the lid 136 by the cross bar 219. The cross bar 219 is secured to the lid 136 by attachments 288 and 289. Similar to the lower film guide 142, the upper film guide 140 is adjusted for the standard slide mount 15 sizes by loosening the attachments 288 and 289 and moving the film guide 142 until an alternate placement groove 214 aligns with the placement extension 220 of the cross bar 219. A handle 136A is connected to an upper surface of the lid 136 to "flip back" or alternatively close the lid 136.

Figure 9:
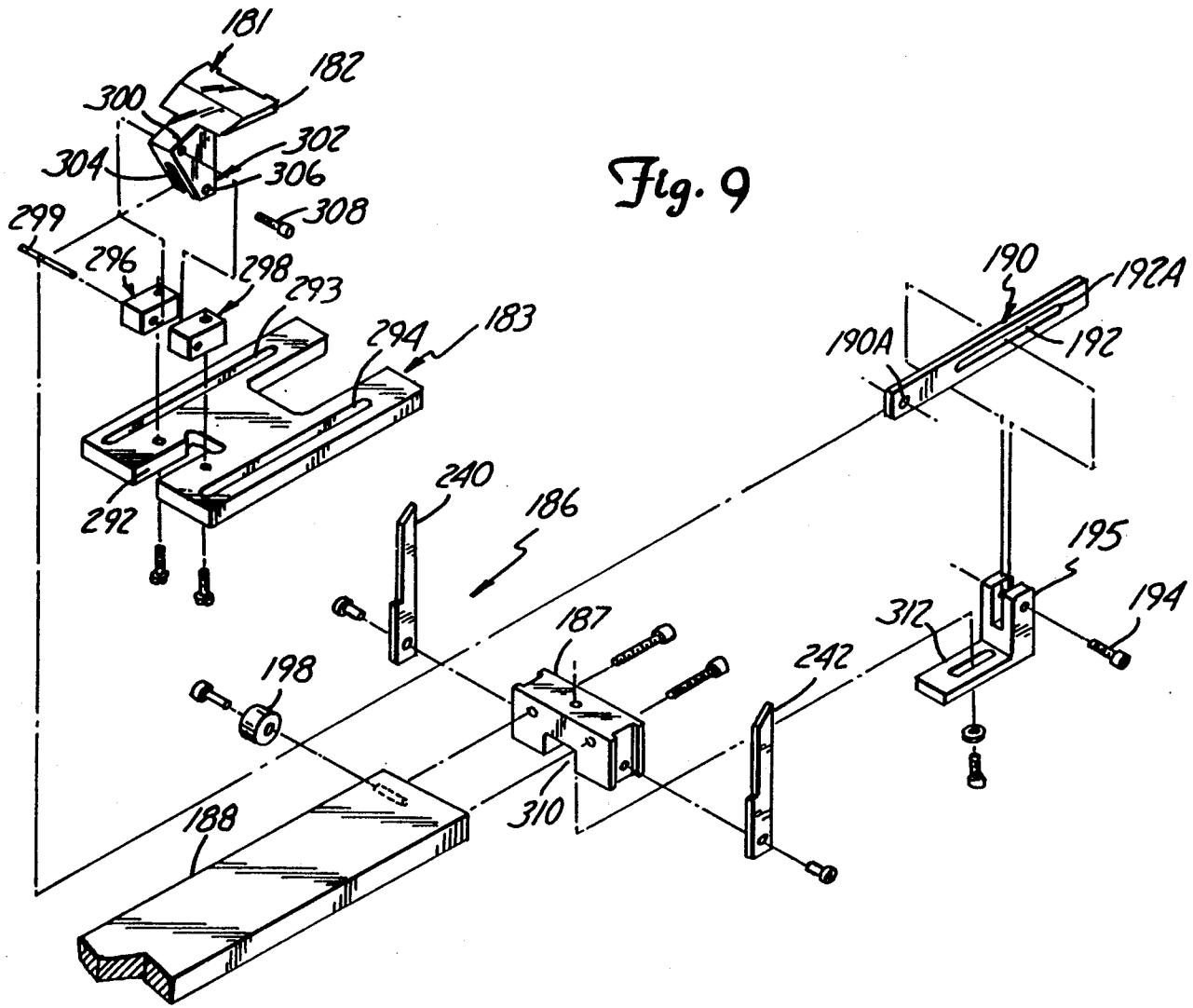
FIG. 9 is an exploded perspective view of the pusher/finger assembly for inserting a severed film transparency into the slide mount at the insertion station.

(10) Detailed Description of the Pusher/Finger Assembly (FIG. 9)

As shown in FIG. 9, the movable pusher support 183 of the pusher/finger assembly 180 (FIGS. 4A–4C) is generally "H" shaped to define a slotted rear portion 292. The movable pusher support 183 includes first and second finger slots 293 and 294 along the legs of the "H". First and second support blocks 296 and 298 are attached to the movable pusher support 183 on either side of the rear slot 292.

A pivot rod 299 extends between the support blocks 296 and 298 and through a pivot slot 300 of the pusher 181 to connect the pusher 181 to the pusher support 183 and define a pivot axis therefor. A stem portion 302 of the pusher 181 extends below the pivot slot 300 and extends through the rear slotted portion 292 of the pusher support 183. The stem portion 302 of the pusher 181 includes a rectangular slot 304 and a screw hole 306 extending therethrough. The link bar 190 is seated within the rectangular slot 304 of the stem 302. A screw 308 extends through the screw hole 306 of the pusher 181 and a corresponding screw hole 190A of the link bar 190 to attach the link bar 190 to the stem 302 of the pusher 181 some distance removed from the pivot axis.

As shown, the first and second fingers 240 and 242 of the finger assembly 186 are attached to either side of the rectangular shaped finger support 187. The fingers 240 and 242 are supported below the movable pusher support 183 (in cooperation with the actuator 188) and extend through the first and second finger slots 293 and 294 of the support 183, respectively, to contact the film transparency 12. When the fingers 240 and 242 disengage the film transparency 12, at the ramped surface 196 (FIGS. 4A–4C), the fingers 240 and 242 are lowered from the finger slots 293 and 294 of the movable pusher support 183. The finger support 187 includes a lower rectangular receiving slot 310 and is attached to a leading end of the actuator 188.

The connecting rod support 195 includes a mounting extension 312 which extends through the rectangular receiving slot 310 of the finger support 187 to operably attach the connecting rod support 195 to the actuator 188. As previously explained, the actuator 188 cooperatively advances the connecting rod 194 with the finger assembly 186 so that it contacts the contact end 192A of the stroke slot 192. When the connecting rod 194 contacts the contact end 192A of the stroke slot 192 further advancement of the actuator 188 is transferred, via the link bar 190, to the pusher 181 to rotate the pusher 181 about the pivot axis. In particular, the pusher 181 is rotated from the retracted position (FIG. 4A) to the engaging position (FIG. 4C) to advance the film transparency 12.

Thereafter, when the connecting rod 194 engages the contact end 192A of the stroke slot 192, the movable pusher support 183 is advanced along the pusher track 184 toward the insertion station 40, in cooperation with the actuator 188, to advance the pusher 181 connected to a rear portion thereof (FIGS. 4A–4C). As shown in FIG. 3, track blocks 320 and 321 having track slots 324 and 325, respectively, extending therealong, cooperate to define the pusher track 184. The track slots 324 and 325 of the blocks 320 and 321 extend below the film receiving supports 230 and 232 along the extent thereof and extend into the insertion station 40 (FIGS. 6A and 6B). The portion of the blocks 320 and 321 extending within the insertion station 40 is supported below the slide track 134 as shown in FIGS. 6A–6B.

A leaf spring (not shown) is upwardly biased against a lower surface of the pusher support 183 to provide drag therefor. The drag introduced by the spring assures that the pusher 181 fully pivots from the retracted position (FIG. 4A) to the engaging position (FIG. 4C) before the pusher support 183 is advanced along the pusher track 184.

(11) Conclusion

When the film transparency 12 is completely inserted into the slide mount 15, an operation cycle of the slide mounter 10 is complete. The operating lever 35 is again rotated forward to continue operation of the slide mounter 10 to prepare additional photographic slides. Each time a new slide mount 15 is ejected to the insertion station 40, the prepared photographic slide is forced from the insertion station to the catch magazine 50. The width of the upper and lower film guides 140 and 142 is small enough that the film guides 140 and 142 fit within the aperture 108 of the slide mount 15 and large enough to guide the width of the film 12 through the second insertion opening 116 without buckling.

Although the present invention has been described with reference to a preferred embodiment, workers skilled in the art will recognize that changes may be made in form and detail without departing from the spirit and scope of the invention.

What is claimed is:

1. An apparatus for mounting a photographic film transparency from a photographic film web into a slide mount of the type formed of upper and lower frame sections connected along an outer border to form a pocket, the upper and lower frame sections defining a central aperture enclosed by an inner border, the slide mount having a slit adjacent to the outer border defining a first insertion opening at the slit and a second insertion opening between the upper and lower frame sections along a side of the inner border furthest from the slit, the apparatus comprising:

a frame;

means for positioning the slide mount at an insertion station to receive the film transparency through the first and second insertion openings of the slide mount;

means for pushing the film transparency through the first insertion opening and through the second insertion opening into the pocket of the slide mount;

upper and lower film guides for guiding a leading edge of the film transparency through the insertion openings of the slide mount to position the film transparency across the aperture of the slide mount, said upper and lower film guides being supported relative to the frame at the insertion station for alignment with the slide mount;

means for applying a bias which normally biases the upper and lower film guides towards one another in a closed position; and means for supporting the upper and lower film guides against the bias relative to the slide mount to open the upper and lower film guides to define a passage therethrough for inserting the film transparency.

2. The apparatus of claim 1 wherein the upper and lower film guides include:

tapered surfaces biased in opposed relation to define a tapered passage having an inlet to capture the leading edge of the film transparency and a smaller outlet aligned with an insertion opening between the upper and lower frame sections of the slide mount to guide the film transparency into the pocket of the slide mount.

3. The apparatus of claim 1 wherein a leaf spring functions against the upper film guide to bias it toward the lower film guide.

4. The apparatus of claim 1 wherein the upper and lower film guides include stepped edges designed to seat against the upper and lower frame sections of the slide mount to force the film guides against the bias to define the passage so that the passage is aligned with the slide mount.

5. The apparatus of claim 1 wherein the upper and lower film guides are aligned relative to the second insertion opening and further including means for separating the upper and lower film guides against the bias to advance a slide mount to the insertion station and enclose the film guides within the aperture of the slide mount for alignment adjacent to the second insertion opening.

6. The apparatus of claim 5 wherein the means for separating the upper and lower film guides against the bias to advance a slide mount to the insertion station includes cooperating curved surfaces on the upper and lower film guides, the cooperating curved surfaces defining a receiving opening aligned relative to an ejected side mount, wherein the ejected slide mount is advanced towards the receiving opening to contact the cooperating curved surfaces to separate the upper and lower film guides for placement of the ejected slide mount at the insertion station with the upper and lower film guides within the aperture of the ejected mount.

7. The apparatus of claim 1 wherein a helical spring biases the lower film guide toward the upper film guide.

8. The apparatus of claim 1 further including:

means for adjustably supporting the upper and lower film guides relative to the frame.

9. An apparatus for mounting a photographic film transparency from a photographic film web into a slide mount of the type formed of upper and lower frame sections connected along an outer border to form a pocket, the upper and lower frame sections defining a central aperture enclosed by an inner border, the slide mount having a slit adjacent to the outer border defining a first insertion opening at the slit and a second insertion opening between the upper and lower frame sections along a side of the inner border furthest from the slit, the apparatus comprising:

a slide magazine for holding a plurality of slide mounts;

means for ejecting a slide mount from the slide magazine along a slide track to an insertion station;

means for separating the upper and lower frame sections at the slit of the slide mount;

a film track for supporting the photographic film web;

means for severing a film transparency from the film web;

means for pushing the severed film transparency through the slit into the pocket of the slide mount;

upper and lower film guides for guiding a leading edge of the film transparency through the insertion openings of the slide mount to position the film transparency across the aperture of the slide mount, said upper and lower film guides being supported relative to the frame at the insertion station for alignment with the slide mount;

means for applying a bias which normally biases the upper and lower film guides towards one another in a closed position; and means for supporting the upper and lower film guides against the bias relative to the slide mount to open the upper and lower film guides to define a passage therethrough for inserting the film transparency.

10. The apparatus of claim 9 wherein the upper and lower film guides include:

tapered surfaces biased in opposed relation to define a tapered passage having an inlet to capture the leading edge of the film transparency and a smaller outlet aligned with the second insertion opening between the upper and lower frame sections of the slide mount to guide the film transparency into the pocket of the slide mount.

11. The apparatus of claim 9 wherein the film track is perpendicular to the slide track.

12. The apparatus of claim 9 wherein the upper and lower film guides include stepped edges designed to seat against the upper and lower frame sections of the slide mount to force the film guides against the bias to define the passage so that the passage is aligned with the slide mount.

13. The apparatus of claim 9 wherein the upper and lower film guides are aligned relative to the second insertion opening and further including means for separating the upper and lower film guides against the bias to advance a slide mount to the insertion station and enclose the film guides within the aperture of the slide mount for alignment adjacent to the second insertion opening.

14. The apparatus of claim 9 and further including:

means for adjustably supporting the upper and lower film guides relative to the frame.

15. An apparatus for inserting a severed film transparency from a photographic film web into a slide mount formed of upper and lower frame sections connected an outer border to form a pocket therebetween and including a slit through which the film transparency is inserted into the pocket of the slide mount, the apparatus comprising:

a frame;

means for supporting a slide mount at an insertion station relative to the frame;

means for inserting the severed film transparency into the pocket of the slide mount; and upper and lower film guides supported relative to the frame at the insertion station for guiding the film transparency into the pocket of the slide mount, said upper and lower film guides being biased in a normally closed position and being opened to form a passage therebetween for inserting the film transparency, the upper and lower film guides being aligned at the insertion station so that upper and lower frame sections of the slide mount at the insertion station open the upper and lower film guides to form the passage for inserting the film transparency.

16. The apparatus of claim 15 wherein the upper and lower film guides include stepped edges designed to seat against the upper and lower frame sections of the slide mount to separate the upper and lower film guides to form the passage for inserting the film transparency.

17. The apparatus of claim 15 wherein the upper and lower film guides include tapered surfaces in opposed relation to define a tapered passage having an inlet to capture the film transparency being inserted into the pocket of the slide mount and a smaller outlet aligned with an insertion opening between the upper and the lower frame sections of the slide mount to guide the film transparency into the pocket of the slide mount.

18. An apparatus for mounting a photographic film transparency from a photographic film web into a slide mount of the type formed of upper and lower frame sections connected along an outer border to form a pocket, the upper and lower frame sections defining a central aperture enclosed by an inner border, the slide mount having a slit adjacent to the outer border defining a first insertion opening at the slit and a second insertion opening between the upper and lower frame sections along a side of the inner border furthest from the slit, the apparatus comprising:

means for positioning the slide mount at an insertion station to receive the film transparency through the first and second insertion openings of the slide mount;

means for pushing the film transparency through the first insertion opening and through the second insertion opening into the pocket of the slide mount;

means for guiding a leading edge of the film transparency through the second insertion opening to position the film transparency across the aperture of the slide mount, the means for guiding including upper and lower film guides having tapered surfaces biased in opposed relation to define a tapered passage having an inlet to capture the leading edge of the film transparency and a smaller outlet aligned with the second insertion opening between the upper and lower frame sections of the slide mount to guide the film transparency across the aperture and through the second insertion opening into the pocket of the slide mount.

19. The apparatus of claim 18 wherein the upper and lower film guides are spring biased in opposed relation together.

20. The apparatus of claim 19 wherein the upper and lower film guides include stepped edges designed to seat against the upper and lower frame sections of the slide mount to separate the film guides against the spring bias to define the tapered passage and the inlet and the outlet thereof.

21. The apparatus of claim 19 wherein the upper and lower film guides include cooperating curved surfaces aligned to define a receiving opening for the slide mount to separate the upper and lower film guides against the spring bias to advance the slide mount to enclose the film guides, with the outlet positioned adjacent to the second insertion opening.

22. The apparatus of claim 19 wherein a leaf spring functions against the upper film guide to force it toward the lower film guide.

23. The apparatus of claim 19 wherein a helical spring forces the lower film guide toward the upper film guide.

24. The apparatus of claim 18 further including:

means for adjustably supporting the upper and lower film guides.

25. An apparatus for mounting a photographic film transparency from a photographic film web into a slide mount of the type formed of upper and lower frame sections connected along an outer border to form a pocket, the upper and lower frame sections defining a central aperture enclosed by an inner boarder, the slider mount having a slit adjacent to the outer border defining a first insertion opening at the slit and a second insertion opening between the upper and lower frame sections along a side of the inner border furthest from the slit, the apparatus comprising:

a slide magazine for holding a plurality of slide mounts;

means for ejecting a slide mount from the slide magazine along a slide track to an insertion station;

means for separating the upper and lower frame sections at the slit of the slide mount to define the first and second insertion openings;

a film track for supporting the photographic film web;

means for severing a film transparency from the film web;

means for pushing the severed film transparency through the first insertion opening and through the second insertion opening into the pocket of the slide mount; and film guide means cooperating with the second insertion opening for guiding the leading edge of the film transparency across the aperture and through the second insertion opening of the slide mount, the film guide means including upper and lower film guides having tapered surfaces in opposed relation to define a tapered passage having an inlet to capture the leading edge of the film transparency and a smaller outlet aligned with the second insertion opening between the upper and lower frame sections of the slide mount to guide the film transparency across the aperture and through the second insertion opening of the slide mount.

26. The apparatus of claim 25 wherein the upper and lower film guides are spring biased in opposed relation together.

27. The apparatus of claim 26 wherein the upper and lower film guides includes stepped edges designed to seat against the upper and lower frame sections of the slide mount to separate the film guides against the spring biased to define the tapered passage and the inlet and outlet thereof.

28. The apparatus of claim 26 wherein the upper and lower film guides include cooperating curve surfaces aligned to define a receiving opening for the slide mount to separate the upper and lower film guides against the spring bias to advance the slide mount to enclosed the film guides, with the outlet position adjacent to the second insertion opening.

29. The apparatus of claim 25 and further including:

means for adjustably supporting the upper and lower film guides.

* * * * *

UNITED STATES PATENT AND TRADEMARK OFFICE

CERTIFICATE OF CORRECTION

PATENT NO. : 5,222,347

DATED : June 29, 1993

INVENTOR(S) : WILBUR GERRANS

It is certified that error appears in the above-identified patent and that said Letters Patent is hereby corrected as shown below:

Col. 14, line 27, delete "slider", insert --slide--

Signed and Sealed this

Twenty-fifth Day of January, 1994

*Attest:*

*Attesting Officer*

Bruce Lehman

BRUCE LEHMAN

*Commissioner of Patents and Trademarks*